US006705037B2

(12) United States Patent
Van Kirk

(10) Patent No.: US 6,705,037 B2
(45) Date of Patent: Mar. 16, 2004

(54) APPARATUSES AND METHODS FOR MOUNTING AN OPTICAL DEVICE TO AN OBJECT

(76) Inventor: J. Robert Van Kirk, 601 Academy Ave., Sewickley, PA (US) 15143

( * ) Notice: Subject to any disclaimer, the term of this patent is extended or adjusted under 35 U.S.C. 154(b) by 0 days.

(21) Appl. No.: 10/120,059

(22) Filed: Apr. 10, 2002

(65) Prior Publication Data

US 2003/0192224 A1 Oct. 16, 2003

(51) Int. Cl.[7] ..... F41G 1/38
(52) U.S. Cl. ..... 42/126; 42/124; 42/125
(58) Field of Search ..... 42/124–126

(56) References Cited

U.S. PATENT DOCUMENTS

| | | | | |
|---|---|---|---|---|
| 2,165,221 A | | 7/1939 | Burton | |
| 2,165,796 A | | 7/1939 | Humeston | |
| 2,208,913 A | | 7/1940 | Unertl | |
| 2,336,107 A | | 12/1943 | Litschert | |
| 2,449,551 A | * | 9/1948 | Garand | 42/124 |
| 2,491,431 A | | 12/1949 | Unertl et al. | |
| 2,663,083 A | * | 12/1953 | Harms | 42/126 |
| 2,715,275 A | | 8/1955 | Kipp | |
| 2,717,447 A | | 9/1955 | Leupold | |
| 2,889,628 A | | 6/1959 | Musser et al. | |
| 3,097,432 A | | 7/1963 | Shaw | |
| 3,597,040 A | * | 8/1971 | Gotoh | 359/424 |
| 4,085,511 A | | 4/1978 | Kovac | |
| 4,247,161 A | | 1/1981 | Unertl, Jr. | |
| 4,249,315 A | | 2/1981 | Hopson, III | |
| 4,310,980 A | | 1/1982 | Pilkington | |
| 4,397,107 A | * | 8/1983 | Holden | 42/126 |
| 4,574,508 A | | 3/1986 | Ross | |
| 4,688,345 A | | 8/1987 | Kilgour | |
| 4,912,853 A | | 4/1990 | McDonnell et al. | |
| 5,035,487 A | | 7/1991 | Herz | |
| 5,070,637 A | | 12/1991 | French | |
| 5,101,590 A | | 4/1992 | Hawkins | |
| 5,144,752 A | | 9/1992 | Boeke et al. | |
| 5,680,725 A | | 10/1997 | Bell | |
| 5,694,712 A | | 12/1997 | Plonka | |
| 5,771,595 A | | 6/1998 | Bell | |
| 5,784,822 A | | 7/1998 | Korapaty | |
| 5,787,630 A | | 8/1998 | Martel | |
| 6,026,580 A | | 2/2000 | LaRue | |
| 6,315,256 B1 | * | 11/2001 | Tolar | 248/230.4 |

FOREIGN PATENT DOCUMENTS

| | | |
|---|---|---|
| FR | 492773 | 12/1915 |
| JP | 08267213 | 10/1996 |
| JP | 11101370 | 4/1999 |

* cited by examiner

*Primary Examiner*—Charles T. Jordan
*Assistant Examiner*—Bret Hayes
(74) *Attorney, Agent, or Firm*—Kirkpatrick & Lockhart LLP

(57) ABSTRACT

Apparatus and methods for removably mounting an optical sighting device such as a telescopic sight to an object, which may, for example, comprise a surveyor's tool or a firearm, etc. In one embodiment, the apparatus may include a front mounting assembly and a rear mount assembly. In one embodiment, a first mounting member that is attachable to the object and shaped to support a portion of the optical sighting device therein. A second mounting member is pivotally, movably or removably coupled to the first mounting member and is selectively movable between a first position wherein the optical sighting device may be supported between the first mounting member and the second mounting member and a second position wherein the optical sighting device may be removed from between the first and second mounting members. A windage adjustment member may be supported on one of the first and second mounting members and an elevation adjustment member may be supported on one of the first and second mounting members. A resilient support member may also be supported on one of the first and second mounting members. A telescopic sight that has reticle with crosshairs and a circle whose center coincides with the center point of the crosshairs is also disclosed.

52 Claims, 14 Drawing Sheets

APPARATUSES AND METHODS FOR MOUNTING AN OPTICAL DEVICE TO AN OBJECT

BACKGROUND OF THE INVENTION

1. Field of the Invention

The invention relates to telescopic sights and methods for mounting telescopic sights and, more particularly, to a detachable telescopic sight with a fixed reticle (internal crosshairs, posts, etc.) that may be mounted on more than one firearm without requiring resighting of the firearm after it has been moved from one firearm to another.

2. Description of the Invention Background

It is reported that Sir Isaac Newton was the first person to put a telescope on a gun with which he is said to have experimented extensively for distant shooting. From the early involvement of the renowned physicist in the late $17^{th}$ and early $18^{th}$ centuries with a form of an unadjustable telescope permanently mounted to the barrel of the gun, there has been much change and experimentation giving rise to considerable improvement in the optics, adjustability and precision for firearms. This may be similarly true for devices employing the same technology such as surveyor sights. However, even in this $21^{st}$ century anyone even casually familiar with scoped firearms would note the basic similarity of what is used today with what was used many hundreds of years ago.

Over the years, it appears that roughly three general phases have evolved and coexisted for firearm scopes. These stages were telescope sights with no adjustment, telescope sights with external adjustment and telescope sights with internal adjustment. Originally, following the efforts of Sir Isaac Newton, the gun barrel had affixed permanently to it a form of telescope which was initially adjusted so as to be "zeroed" to whatever range the customer wanted. If the marksman were to shoot at any other range, he would have to aim the firearm off of the target or bulls eye in some fashion to compensate.

It is reported that by the 1860's, the beginning of the second phase had started where an external "elevation" adjustment had developed for raising and lowering the point of impact to compensate for distance and the gravitational effects on the bullet. This was generally accomplished with the use of threaded and clamp screws permitting the rear of the scope to be raised and lowered and/or permitting the front of the scope to be so adjusted.

The exploits of scope equipped sharpshooters in the American Civil War were well reported and are believed to have been a cause for the public's interest thereafter in scope sighted rifles. The movie "Gettysburg" shows General Reynolds being shot from a considerable distance by a Confederate sniper using what appeared to be a British Whitworth rifle fitted with one of the various British supplied scopes which permitted this rudimentary elevation adjustment.

The second "phase" commenced mostly after the Civil War when firearm scopes were devised that allowed "external" adjustment of the scope to permit changes in elevation, as well as changes in windage (left to right movement of the point of impact of the projectile). The third phase, and essentially the presently existing phase, started in about the 1930's when an internal adjustment was provided so that the reticule within the tube of the scope could be moved (originally only for elevation).

Today, most all rifle scopes manufactured in the United States and abroad are of the "internal adjustment" variety. In these, the tube holding the optical lenses is attached securely with mounts and rings to the rifle (usually the receiver) so that the scope itself cannot move. The required reticule adjustment for elevation and windage occurs internally within the tube by use of knobs on the outside of the tube. The internal adjustment scope of today has certain advantages, particularly in size and sleekness of appearance with fewer outside features. Notwithstanding these advantages it has several notable deficiencies from the more modern externally adjusted variety, which in the target shooting community in the middle $20^{th}$ century came to be known as "return to battery" type rifle scopes.

A return to battery type scope typically has a front and rear mount attached to the rifle and the scope tube is free to move forward and then backwards within these mounts. The stability of the tube is maintained by points (including springs) located in each ring. While any number of contact points could be utilized, the preferred approach would be three contact points under pressure thereby utilizing the principle of the "three legged stool" effect, to thereby assure that the scope tube is returned to where it had been adjusted. Upon recoil of the rifle, the scope moves somewhat forward relative to the rifle as the rifle jolts backward. The scope then is pushed back by the marksman so that it "returns to battery." This permitted movement is useful in preserving the optics from breaking or "shaking loose." The scope itself is often pushed back or "returned to battery" by a spring around and on the outside of the tube of the scope. On the rear mount there is a precision type of industrial micrometer on the top and side which puts pressure on the side of the scope tube to push and hold the scope left or right (windage adjustment) or move it up or down for elevation adjustment. U.S. Pat. No. 2,208,913 to Unertl and U.S. Pat. No. 2,336,107 to Litschert disclose mounting arrangements for return to battery types of scopes.

One optical advantage of the return to battery type scope is that the sighting reticule (often referred to as "crosshairs") is always centered in the middle of the lens since it cannot move. This is the point where optical performance is believed to be optimal. As is commonly known from photographic experience, the further an image approaches the edge of a lens the more diminished in quality it becomes. With the internal adjustment scopes of today in order to get the point of impact adjusted adequately a shooter often has the scope's reticule very far off center of the lens. In addition to this optical advantage, the external adjustments of return to battery type scopes permit a greater range of adjustment thereby permitting much longer accurate shots. It is for this reason that many of the return to battery type scopes manufactured in the United States over the last 50 or so years have been sold to the Federal Bureau of Investigation, the U.S. Marine Corps and the Secret Service.

Over the $20^{th}$ century more and more improvements were made to rifle scopes, including objective lens adjustments to deal with parallax, multiple lens coatings to improve optics, internal reticule adjustments (for both elevation and windage), devices to secure such adjustments from recoil movement, centering of the reticule after adjustment, different types of reticule, lighter weight, stronger materials, computer improved optics, etc. These improvements and changes have made the rifle scopes used by today's hunters and target shooters a much more usable and effective devise for improving the accuracy of firearms in general, whether for sporting, police or military application.

While much has occurred in the last 100 years to improve rifle scopes, one key aspect has remained the same and unchanged and that is the practice of designing scopes and their mounting mechanisms such that one scope is intentionally and practically "wedded" to one rifle. When moving a scope from one firearm to another, the scope must be resighted to the new rifle, most often quite laboriously. It is not uncommon to spend two or three hours or much more and 20 to 80 shells (which could cost $50 to $100 or more) to "sight in" a scope newly put on a rifle. It has been said that a good rule of thumb for a hunter or target shooter is to spend at least as much on a scope as on the rifle to which it is to be affixed. This presently is a reasonable rule of thumb, and it is easy to see how expensive this becomes if a hunter or a marksman has several rifles to shoot different type and size cartridges for entirely different purposes.

Thus, there is a need for an apparatus and mounting methods whereby a single scope may be moved from firearm to firearm of varying types without requiring tools, gunsmithing services or the normal resighting procedures encountered when using prior apparatuses and methods.

SUMMARY

One embodiment of the invention comprises apparatus for removably mounting an optical sighting device to an object. The apparatus may include a first mounting member that is attachable to the object and shaped to support a portion of the optical sighting device therein. A second mounting member may be movably coupled to the first mounting member such that it is selectively movable between a first position wherein the optical sighting device may be supported between the first mounting member and the second mounting member and a second position wherein the optical sighting device may be removed from between the first and second mounting members. The apparatus may further include a windage adjustment member supported on one of the first and second mounting members and an elevation adjustment member supported on one of the first and second mounting members. While it is customary for the elevation and windage adjustment to be toward the rear of the rifle for ease in adjusting them by the marksman, various embodiments of the present invention could just as easily employ the micrometer-type adjustment in the front mount. Other possibilities exist within the overall spirit of the invention such as having the windage micrometer type adjustment in the front and the elevation in the rear or vice versa. A resilient support member may also be supported by one of the first and second mounting members. The object may comprise a surveyor's device (tripod, etc.) or a firearm. The term "firearm" as used herein may comprise centerfire, rim fire, muzzle loading, etc. rifles, shotguns, pistols, bows, crossbows, and essentially any apparatus that discharges a projectile that must be aimed to hit a desired mark, object, or location. The telescopic device may comprise a telescopic sight with a fixed or adjustable reticle. The reticle may comprise crosshairs that have a center point and a circle whose center coincides with the centerpoint of the crosshairs. However, other reticle arrangements may be employed.

Another embodiment of the present invention comprises a telescopic sight system for firearms that includes a telescopic sight and a front mounting assembly attached to the firearm for detachably supporting a portion of the telescopic sight on the firearm. The system further includes a rear mounting assembly that includes a first rear mounting member attached to the firearm and shaped to support another portion of the telescopic sight therein and a second rear mounting member that is pivotally coupled to the first rear mounting member. The second rear mounting member is selectively pivotable between a first retaining position wherein the another portion of the telescopic sight is supported between the first and second rear mounting members and a second position wherein the another portion of the telescopic sight may be removed from between the first and second rear mounting members. A windage adjustment member is supported on one of the first and second rear mounting members. An elevation adjustment member is also supported on one of the first and second rear mounting members. At least one resilient support member is also mounted to one of the first and second rear mounting members.

Another embodiment of the present invention comprises a method of using a single telescopic sight on a plurality of firearms. One form of the method may include mounting one mounting arrangement on a first firearm, the mounting arrangement comprising a rear mounting assembly for releasably attaching the telescopic sight to the firearm. The rear mounting assembly has elevation and windage adjustment members thereon. The method may further include releasably mounting the telescopic sight in the mounting arrangement and adjusting the windage and elevation adjustment members to orient the telescopic sight in a desired orientation. The method may further include removing the telescopic sight from the mounting arrangement without further adjusting the windage and elevation adjustment members and mounting another mounting arrangement on another firearm. The another mounting arrangement comprises another rear mounting assembly for releasably attaching the telescopic sight to the another firearm. The another rear mounting assembly also has another elevation and windage adjustment members thereon. In addition, the method may include releasably mounting the telescopic sight in the another mounting arrangement and adjusting the another windage and elevation adjustment members to orient the telescopic sight in another desired orientation on the second firearm. Thereafter, the telescopic sight may be removed from the another mounting arrangement without further adjusting the another windage and elevation adjustment members and remounting the telescopic sight to the first mounting arrangement such that the telescopic sight is in the desired orientation without readjusting the elevation and windage adjustment members.

BRIEF DESCRIPTION OF THE DRAWINGS

In the accompanying Figures, there are shown present embodiments of the invention wherein like reference numerals are employed to designate like parts and wherein.

DETAILED DESCRIPTION OF THE INVENTION

Figure 1:
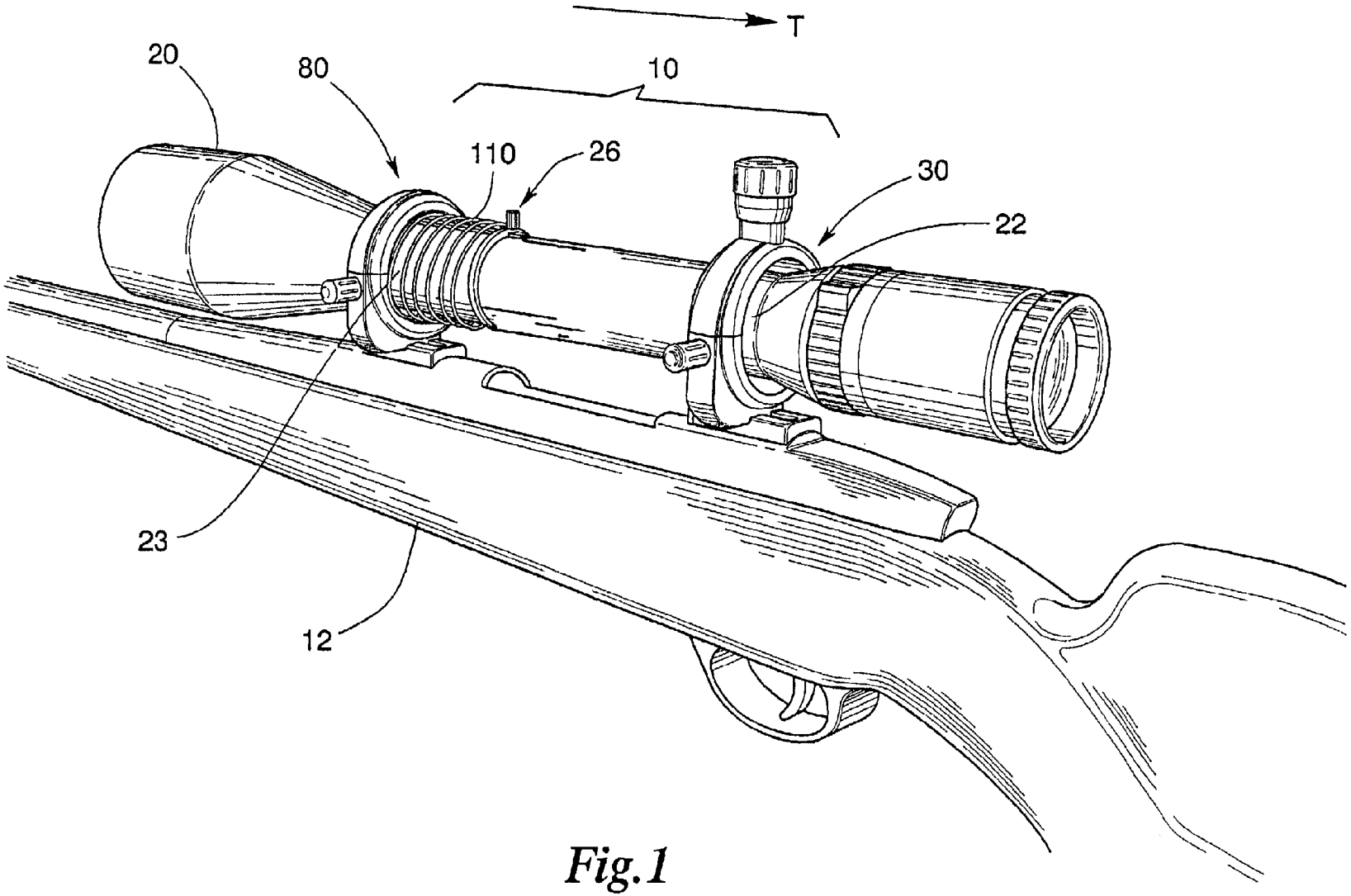
FIG. 1 is a partial perspective view of one embodiment of the mounting system of the present invention employed to mount a telescopic sight to a firearm.

Referring now to the drawings for the purpose of illustrating the various embodiments of the invention and not for the purpose of limiting the same, it is to be understood that standard components or features that are within the purview of an artisan of ordinary skill and do not contribute to the understanding of the various embodiments of the invention are omitted from the drawings to enhance clarity. Furthermore, while the various embodiments of the present invention are particularly well suited for use in connection with firearms (rifles, pistols, etc.), those of ordinary skill in the art will readily appreciate that the various embodiments of the present invention may be successfully employed in connection with a wide variety of other objects. For example, various embodiments of the present invention could be successfully adapted for use in connection with bows, crossbows, surveyor sights, etc.

More particularly and with reference to FIG. 1, there is shown a mounting system 10 for mounting an optical sighting device such as, for example, a telescopic sight 20 to an object 12. In this embodiment, the object 12 is a conventional firearm (rifle). However, as was mentioned above, object 12 may comprise a pistol, a bow, a surveyor's tripod or support stand, etc. Also in this embodiment, the telescopic sight 20 may be a conventional telescopic sight that has a fixed reticle or even one which has an internally adjustable reticle. Those of ordinary skill in the art will appreciate that a variety of different telescopic sights with a variety of different recticle arrangements (i.e., crosshairs, posts, dots, etc.) may be successfully employed.

Figure 2:
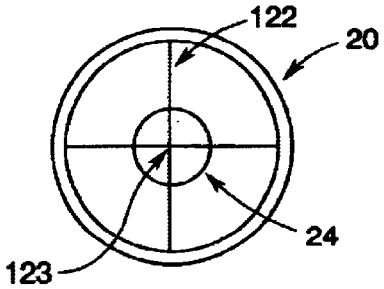
FIG. 2 is an end view of a portion of one embodiment of a telescopic sight of the present invention.

In one embodiment of the present invention, depicted in FIG. 2, the reticle arrangement comprises crosshairs 122 that has a relatively small (i.e., approximately 0.5 inches (12.7 mm) in diameter) circle 24 whose center point coincides with the center point 123 of the crosshairs. It is a known phenomenon that the human eye attempts to "center" an image within a circle. Thus, it will be appreciated that the circle 24 will serve to permit the shooter to more quickly and accurately line up the reticle on the proposed point of impact. As the present Detailed Description proceeds, however, it will become apparent to the skilled artisan that various sight mounting systems of the present invention could also be employed to successfully mount a telescopic sight that has non-fixed (internally adjustable) reticles. However, it is anticipated that when using the various sight mounting systems of the present invention, the user may not have to, or want to, use the internal recticle adjustments when moving the telescopic sight from one object (firearms, tripods, etc.) to another such object.

In the embodiment depicted in FIG. 1, the sight system 10 comprises a rear mounting assembly 30 and a front mounting assembly 80. Those of ordinary skill in the art will of course appreciate, however, that the rear mounting assembly 30 could conceivably be used alone to mount a telescopic sight 20 to an object 12 depending upon the particular application. One embodiment of a rear mounting assembly 30 is depicted in FIGS. 3–6. As can be seen in those Figures, this embodiment may include a first mounting member 32 that is attachable to the object or firearm 12. In this embodiment, the first mounting member 32 may comprise a ring-shaped segment that has a base portion 34 that has an insert cavity 36 formed therein. To attach the first mounting member to the firearm 12, an insert block 38 (formed from metal or other suitable material) may be attached to the firearm by screws 39 or other suitable fasteners. The skilled artisan will appreciate that it is common practice to provide tapped holes 11 in portions of the firearm 12 to facilitate attachment of telescopic sight mounting rings to the firearm. See FIG. 7. The location, number and size of such holes may vary from manufacturer to manufacturer. Thus, when using prior arrangements, the installer typically must purchase a mounting arrangement that corresponds to the layout of the mounting holes 11 in the firearm 12.

Figure 3:
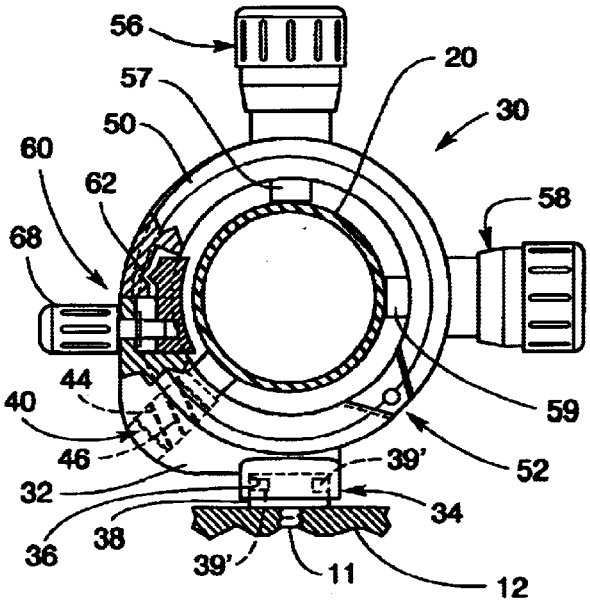
FIG. 3 is a front view of one embodiment of a rear mounting assembly of the present invention in a first position supporting a portion of a telescopic sight therein with portions thereof shown in cross-section.
Figure 4:
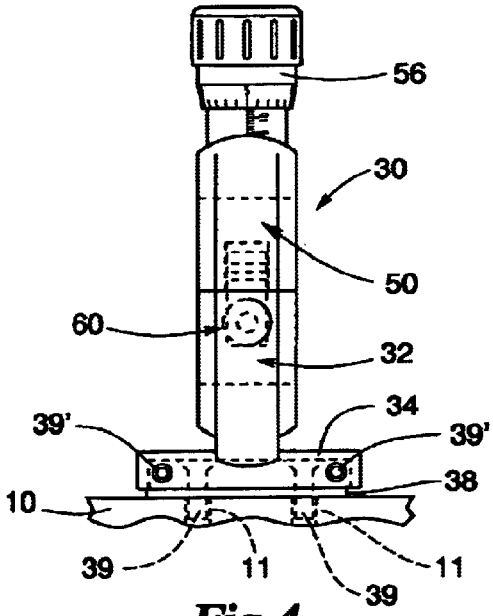
FIG. 4 is a left side elevation view of the rear mounting assembly of FIG. 4.

In this embodiment of the present invention, however, for ease of installation, the insert block 38 may be provided with several holes that match particular mounting hole arrangements employed by different firearm manufacturers. After the insert block 38 has been attached to the firearm 12 through the use of correspondingly sized screws 39, the base portion 34 is placed over the insert block 38 such that the insert block 38 is received within the insert cavity 36 in the base 34. The base 34 may then be attached to the insert by screws 39' that are threaded into corresponding threaded holes in the insert. As can be seen in FIGS. 3 and 4, the screws 39' may extend through the sides of the base 34 into the insert or they may extend down through the top portion of the base 34 into the insert 38. If desired, a commercially available thread locking material maybe applied to the threads of the screws 39, 39' to prevent the screws 39, 39' from becoming loose during use. This is one exemplary method of attaching the first mounting member 32 to the firearm 12. Other suitable methods and apparatuses may be employed without departing from the spirit and scope of the present invention.

In this embodiment, the first mounting member 32 is shaped to receive a portion 22 of the telescopic sight 20 therein. In addition, the first mounting member 32 may also have a support member 40 therein. In one or more embodiments, the support member 40 may be resilient and may comprise a boss 42 that is movably supported within a hole 44 in the first mounting member 32. A biasing member, for example, a spring 46 may be provided in the hole 44 to apply a biasing force to the boss 42. Other resilient support member arrangements (i.e., fluid or pneumatic piston arrangements) may also be employed.

Figure 3A:
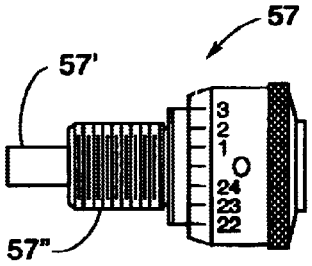
FIG. 3A is a side view of one form of a micrometer assembly that may be employed with various embodiments of the present invention.
Figure 5:
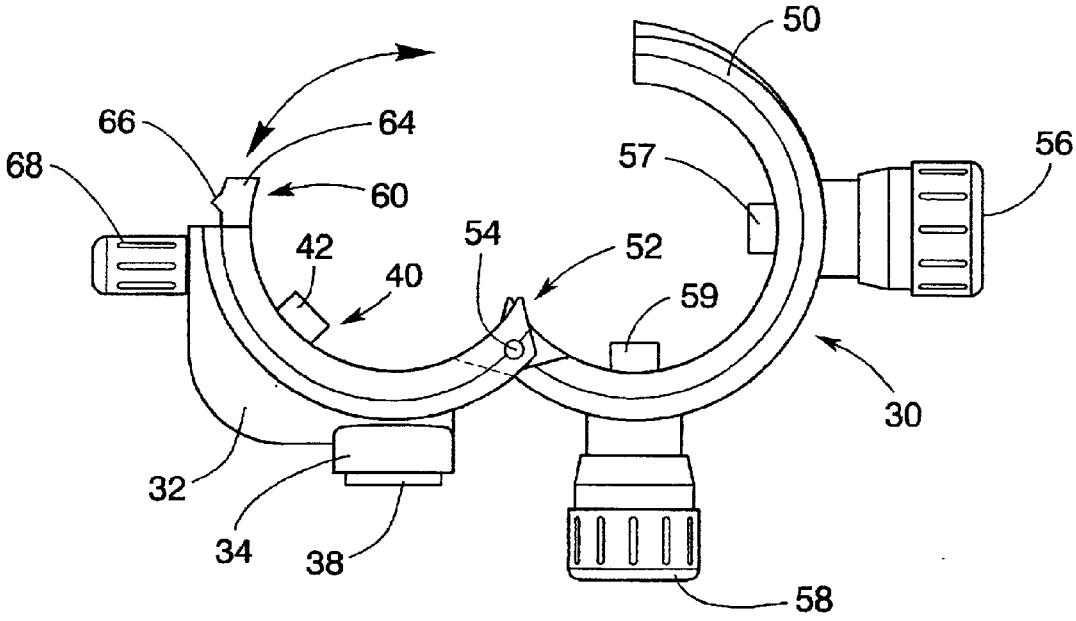
FIG. 5 is a front view of the rear mounting assembly depicted in FIGS. 3 and 4 in a second open position and with the telescopic sight removed therefrom.

Also in this embodiment, a second mounting member 50 is movably coupled to the first mounting member 32 and is selectively movable between a first "closed" position (FIGS. 3 and 4) and a second "open" position (FIG. 5) wherein the telescopic sight 20 may be removed from between the first mounting member 32 and the second mounting member 50. In this embodiment, the second movable mounting member 50 may be pivotally attached to the first mounting member 32 by a hinge assembly 52. The hinge assembly 52 may include a hinge pin 54 arrangement to permit the second mounting member 50 to be pivoted relative to the first mounting member 32 about the hinge pin 54. Other movable attachment arrangements may also be employed. Also in this embodiment, an elevation adjustment assembly 56 and a windage adjustment assembly 58 are attached to the second mounting member as shown in FIGS. 3 and 5. Those of ordinary skill in the art will appreciate that the elevation adjustment assembly 56 may include a simple screw arrangement that may be adjusted to alter or move the position of the telescopic sight 20. In one or more embodiments, a micrometer assembly 57 which includes an adjustable plunger 57' is employed to bear upon and adjust the elevation of the portion 22 of the telescopic sight 20. FIG. 3A depicts one type of micrometer assembly 57 that may be employed. As can be seen in that Figure, the outer housing may include a threaded portion 57" for threaded attachment to the mounting assembly 30. Likewise, the windage adjustment assembly 58 may include a micrometer driven plunger 59 that is oriented to bear upon and adjust the left-right orientation of the portion 22 of the telescopic sight 20 supported in the rear mounting assembly 30. See FIG. 3. The elevation adjustment assembly 56 and the windage adjustment assembly 58 are disclosed herein (throughout the various embodiments) as being mounted to the second mounting member 50. It is conceivable, however, that one or both of such assemblies (56, 58) may be mounted to the first mounting member 32. The present invention is designed to encompass such modifications. Likewise, the resilient support member 40, depending upon the locations of the elevation and windage assemblies (56, 58), could conceivably be mounted on the second mounting member 50. The skilled artisan will appreciate, however, that, regardless of the locations of the elevation adjustment assembly 56, the windage adjustment assembly 58 and the resilient support member 40 within the first and second mounting members (32, 50), those elements cooperate to form a three-point support arrangement for supporting the portion 22 of the telescopic sight 20 therebetween. While the three-point support arrangement appears most logical and effective, it is likewise possible within the spirit and scope of various embodiments of the present invention to use more than one such supports in the first mounting member 32 or in the second mounting member 50.

Also in this embodiment, a latch assembly 60 is employed to releasably retain the second mounting member 50 in the first position. In this embodiment, a locking groove 62 is provided in a portion of the second mounting member 50. A latch member 64 is movably supported on the first mounting member 32 such that it may be selectively movable between a latched position wherein a latch protrusion 66 formed on a latch member 64 is retainingly received within groove 62 (FIG. 6) and a unlatched position wherein the latch protrusion 66 is moved out of the groove 62 (FIG. 3) to permit the second mounting member 50 to be pivoted to the unlatched position. To facilitate movement of the latch member 64, in this embodiment, a knob 68 may be threadedly attached to the latch member 64 and rotatably supported in an aperture 33 in the first mounting member 32 by a split ring 69. See FIG. 6. Thus, by rotating the knob 68 in the appropriate direction, the latch member 64 is axially moved in the directions represented by arrows "A" and "B" in FIG. 6.

Figure 6:
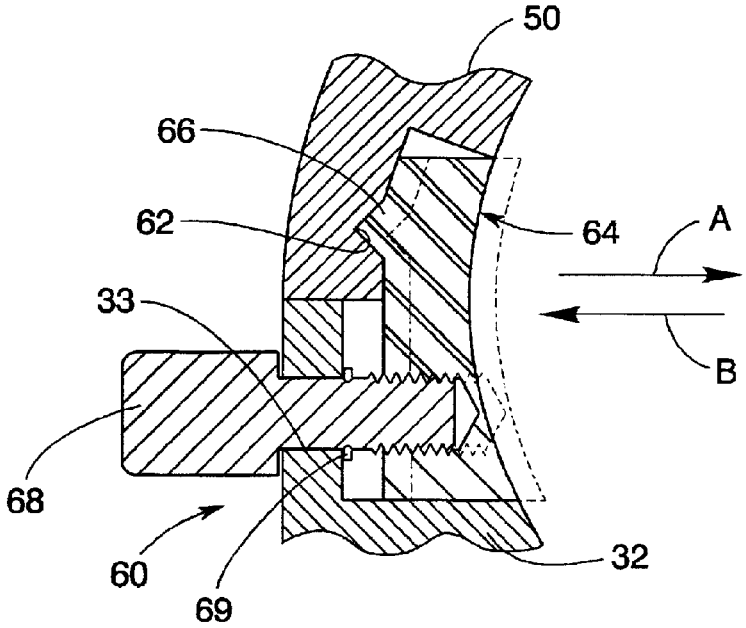
FIG. 6 is an enlarged view of the latch assembly of the rear mounting assembly of FIGS. 3–5.
Figure 6A:
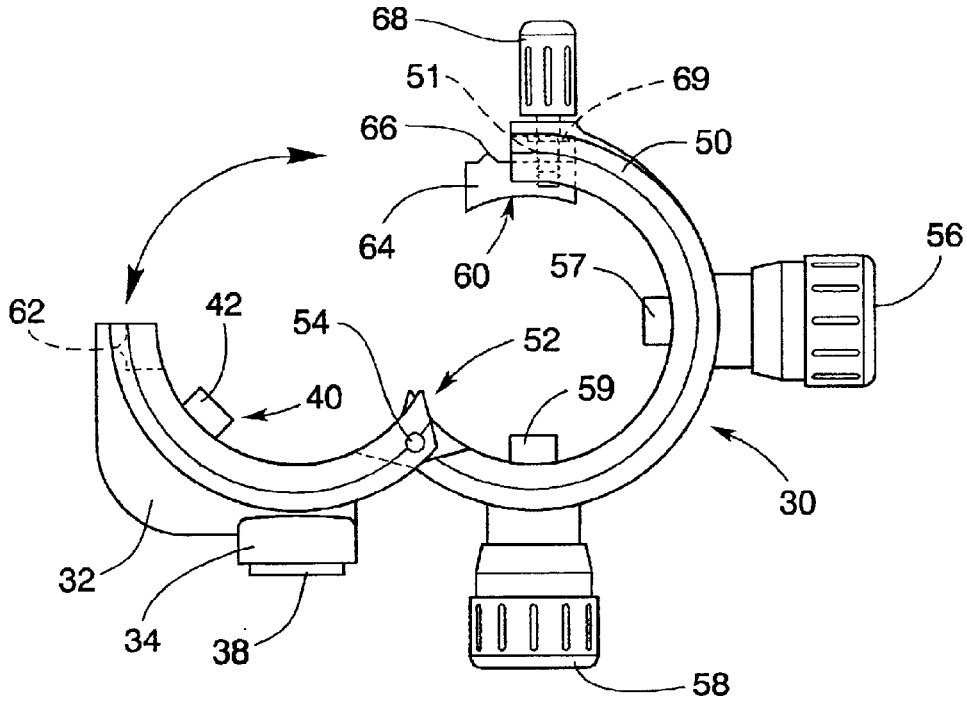
FIG. 6A is an enlarged view of an alternative latch assembly embodiment of the present invention.

FIG. 6A illustrates an alternative latch arrangement to the one depicted in FIGS. 3–6. In this arrangement, the locking groove 62 is provided in a portion of the first mounting member 32. A latch member 64 is movably supported on the first mounting member 32 such that it may be selectively movable between a latched position wherein a latch protrusion 66 formed on the latch member 64 is retainingly received within the groove 62 and a unlatched position wherein the latch protrusion 66 is moved out of the groove 62 to permit the second mounting member 50 to be pivoted to the unlatched position. To facilitate movement of the latch member 64, in this embodiment, a knob 68 may be threadedly attached to the latch member 64 and rotatably supported in an aperture 51 in the second mounting member 50 by a split ring 69.

Figure 7:
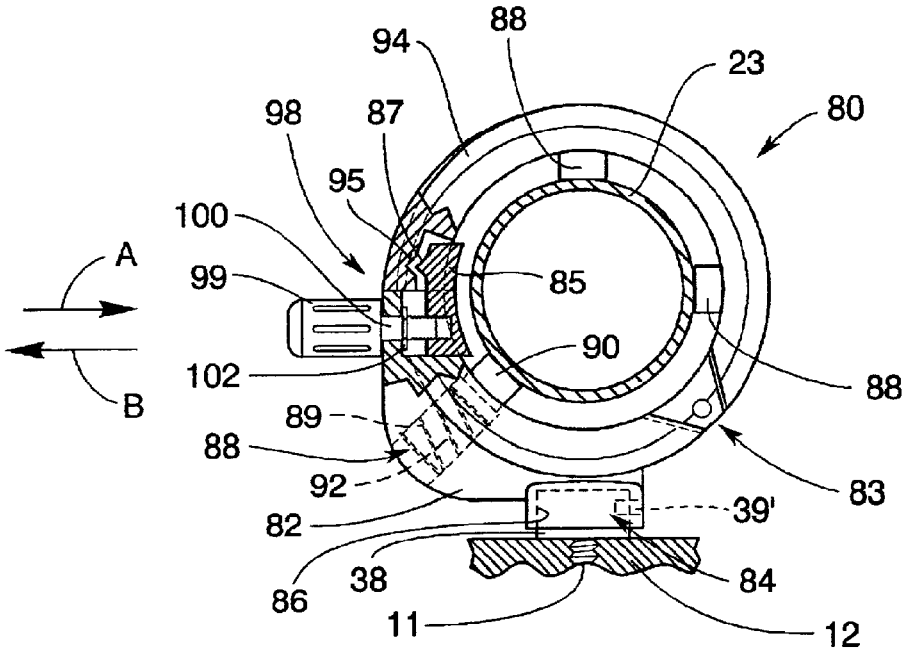
FIG. 7 is a front elevational view of an embodiment of a front mounting assembly of the present invention supporting a portion of a telescopic sight therein.

If employed, the front mounting assembly 80, may comprise a conventional mounting ring or it may comprise a split ring arrangement as shown in FIG. 7. As can be seen in FIG. 7, the front mounting assembly may include a primary mounting member 82 that may comprise a ring-shaped segment that has a base portion 84 that has an insert cavity 86 formed therein. The base portion 84 may be attached to another portion of the object 12 (i.e., firearm) utilizing another insert block 38 and attachment screws (not shown) in the manner described above. However, it is conceivable that the base 84 may be attached to the firearm utilizing other methods. In this embodiment, the primary mounting member 82 is shaped to receive another portion 23 of the telescopic sight 20 therein. In addition, the primary mounting member 82 may have a resilient support member 88 therein. The support member 88 may comprise a boss 90 that is movably supported in a hole 89. A biasing member, for example, a spring 92 may be provided in the hole 89 to apply a biasing force to the boss 90. Other support member arrangements may also be employed.

Also in this embodiment, a secondary mounting member 94 may be movably coupled to the primary mounting member 82 by a hinge assembly 83 and is selectively movable between an open position for receiving a portion 23 of the telescopic sight 20 and a closed position (FIG. 7). The secondary mounting member 94 may also have two resilient support members 88 therein to form a three-point support arrangement for supporting a portion 23 of the telescopic sight 20 when the front mounting assembly 80 is in the closed position. Those of ordinary skill in the art will of course appreciate that the arrangement of the resilient support members 88 in the primary and secondary-mounting members (82, 94) may vary in type, style and number without departing from the spirit and scope of the present invention. A latch assembly 98 which may be identical in operation and construction as the latch assembly 60 as was described above is also provided in the front mounting assembly 80. In particular, in this embodiment, a locking groove 95 may be provided in a portion of the second mounting member 94. A latch member 85 is movably supported on the first mounting member 82 such that it may be selectively movable between a latched position wherein a latch protrusion 87 formed on a latch member 85 is retainingly received within groove 95 and a unlatched position wherein the latch protrusion 87 is moved out of the groove 95 to permit the second mounting member 94 to be pivoted to the unlatched position. To facilitate movement of the latch member 85, in this embodiment, a knob 99 may be threadedly attached to the latch member 85 and rotatably supported in an aperture 100 in the first mounting member 82 by a split ring 102. See FIG. 7. Thus, by rotating the knob 99 in the appropriate direction, the latch member 85 is axially moved in the directions represented by arrows "A" and "B" in FIG. 7. direction, the latch member 85 is axially moved in the directions represented by arrows "A" and "B" in FIG. 7.

Also in this embodiment, a biasing member 110 may be supported on a portion of the telescopic sight 20 and extend between the front mount assembly 80 and a portion of the telescopic sight 20 or protrusion 26 formed thereon. See FIG. 1. The biasing member 110 serves to bias the telescopic sight 20 in the rearward direction (represented by arrow "T") to return it to a desired location after the firearm has been discharged.

To install and use the system 10, the front mounting assembly 80 and the rear mounting assembly 30 may be attached to the object 12 in the manners described above. The second mounting member 50 of the rear mounting assembly 30 is moved to the second open position and the secondary mounting member 94 of the first mounting assembly 80 is pivoted to an open position to permit the telescopic sight 20 to be supported on the first mounting member 32 and resilient support member 40 (FIG. 5) and the primary mounting member 82 and resilient support members 88 (FIG. 7). Thereafter, the secondary mounting member 94 is pivoted to the closed position and latched in that position. Similarly, the first mounting member is pivoted to the first position (FIG. 3) and retained there by latch assembly 60. The user then "sights in" the telescopic sight 20. In the case of a firearm, the elevation and windage adjustment assemblies (56,58) are adjusted to move the telescopic sight 20 in appropriate directions such that the crosshairs 122 or other reticle arrangement within the telescopic sight 20 match the point of impact of the projectile fired out of the firearm 12. After the user has adjusted the elevation and windage adjustment assemblies (56, 58) in the rear mounting assembly 30 to provide the desired sight orientation, the telescopic sight 20 may be removed from the front mounting assembly 80 by unlatching the secondary mounting member 94 (FIG. 7) and pivoting it to an open position. The telescopic sight 20 may then be removed from the mounting system 10 and moved to another mounting system 10 similar to or identical to the mounting system 10 described above that has been mounted on another object or firearm. The telescopic sight 20 is then placed in the front and rear mounting assemblies (30, 80) in the maimers described above. The sighting process is then repeated. When desired, the user may then remove telescopic sight 20 from the second firearm and place it on the mounting system 10 on the first firearm, without having to resight the telescopic sight for that first firearm.

Figure 8:
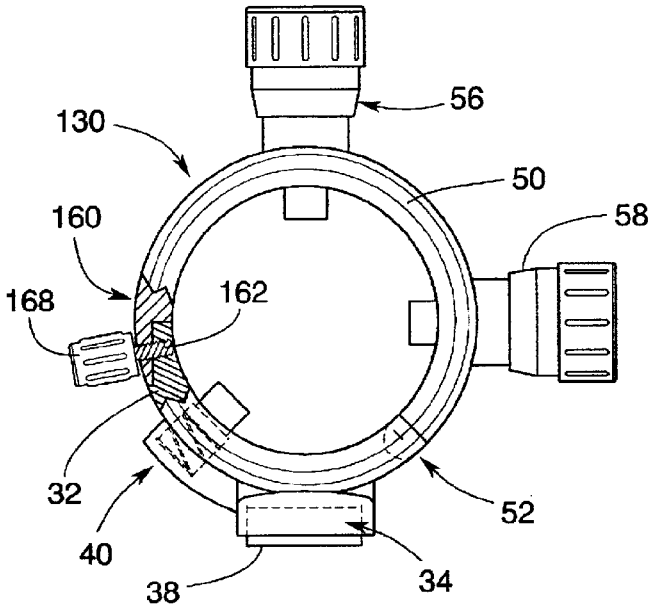
FIG. 8 is a front view of another embodiment of a rear mounting assembly of the present invention in a first position with portions thereof shown in cross-section.
Figure 9:
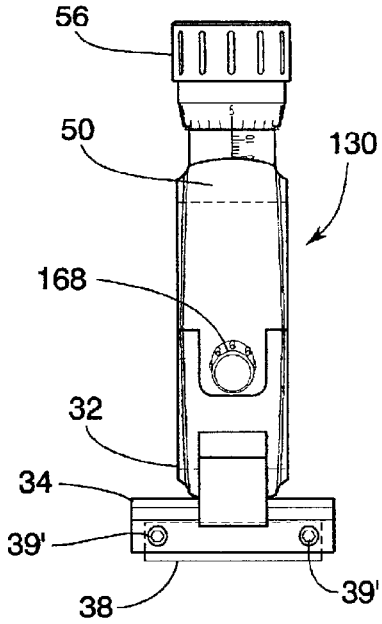
FIG. 9 is a left side elevation view of the rear mounting assembly of FIG. 8.
Figure 10:
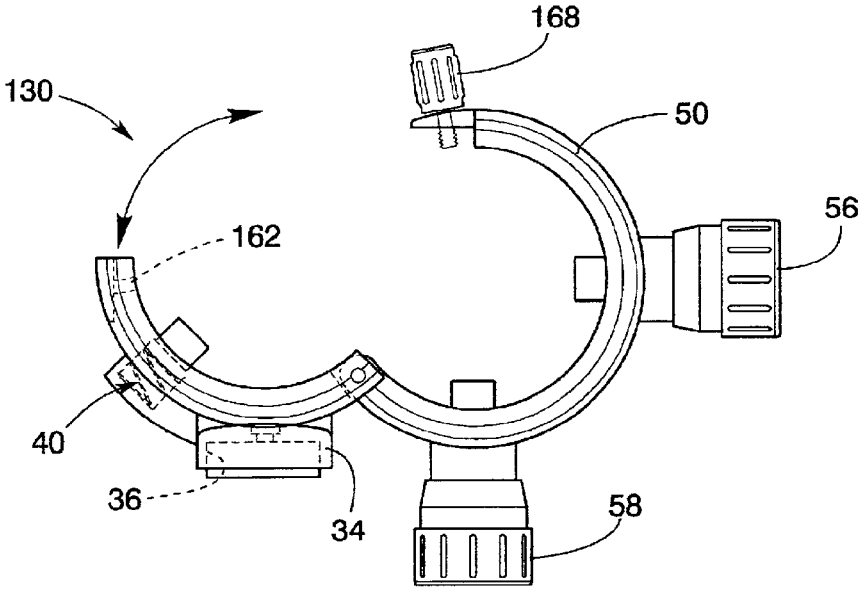
FIG. 10 is a front view of the rear mounting assembly depicted in FIGS. 8 and 9 in a second open position.
Figure 11:
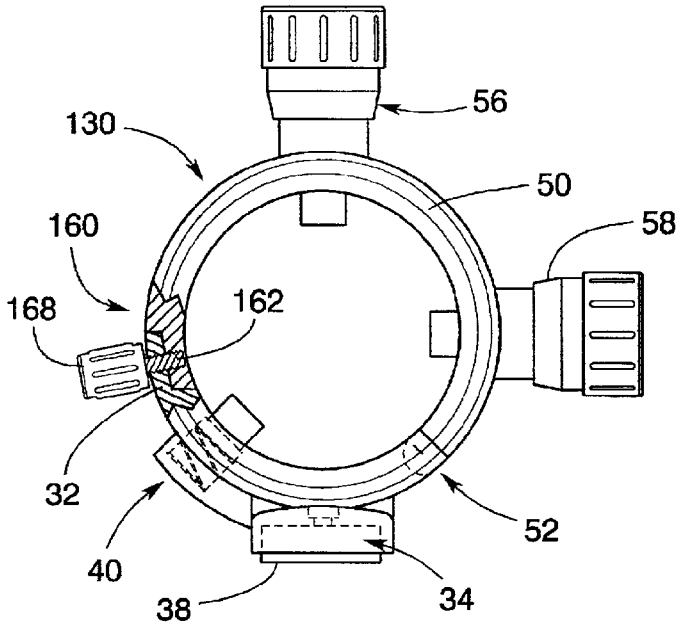
FIG. 11 is a front view of another rear mounting assembly embodiment of the present invention.

Another embodiment of a rear mounting assembly 130 of the present invention is depicted in FIGS. 8–10. This embodiment may be identical to the embodiments described above, except for the latch assembly 160. In this embodiment, the latch assembly 160 may include a threaded bore 162 that is located in a portion of the first mounting member 32 that is adapted to received a threaded lock knob member 168 rotatably attached to the second mounting member 50. When the second mounting member 50 is in the first position (FIG. 8), the threaded lock knob 168 may be threaded into the threaded bore 162 to retain the second mounting member 50 in the closed position. In the embodiment depicted in FIG. 11, the threaded bore 162 is in the second mounting member 50 and the threaded lock knob 168 is supported in the first mounting member 32.

Figure 12:
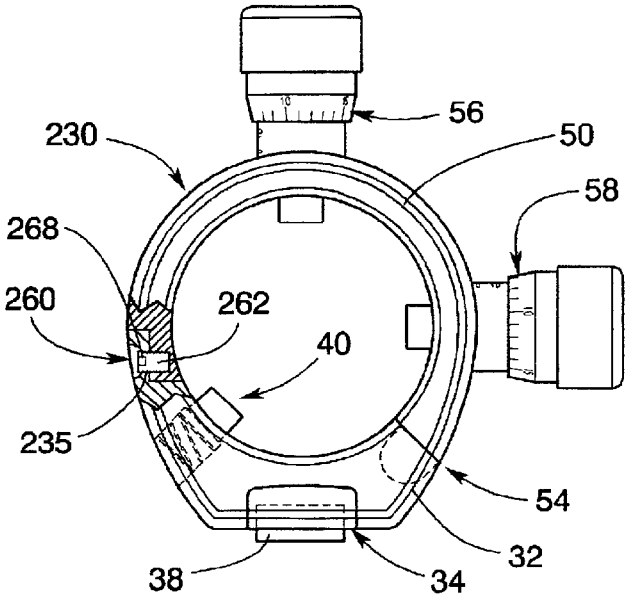
FIG. 12 is a front view of another embodiment of a rear mounting assembly of the present invention in a first position with portions thereof shown in cross-section.
Figure 13:
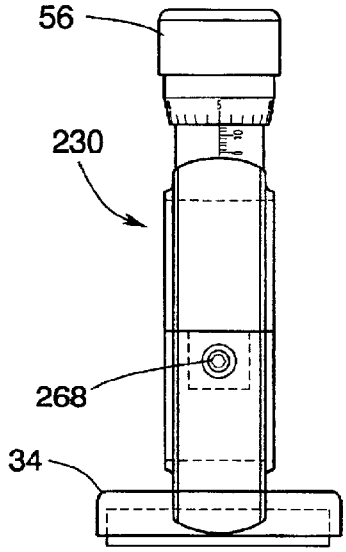
FIG. 13 is a left side elevation view of the rear mounting assembly of FIG. 12.
Figure 14:
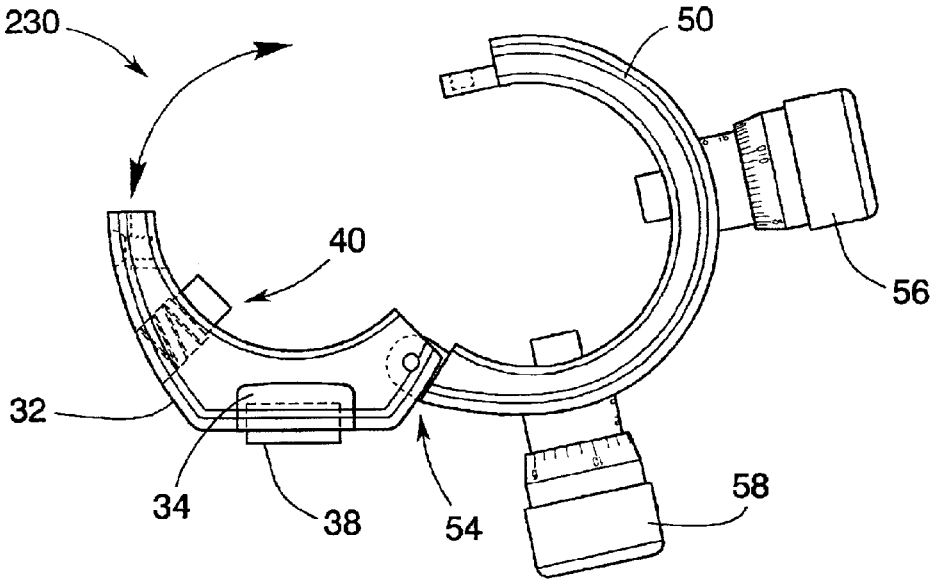
FIG. 14 is a front view of the rear mounting assembly depicted in FIGS. 12 and 13 in a second open position.
Figure 15:
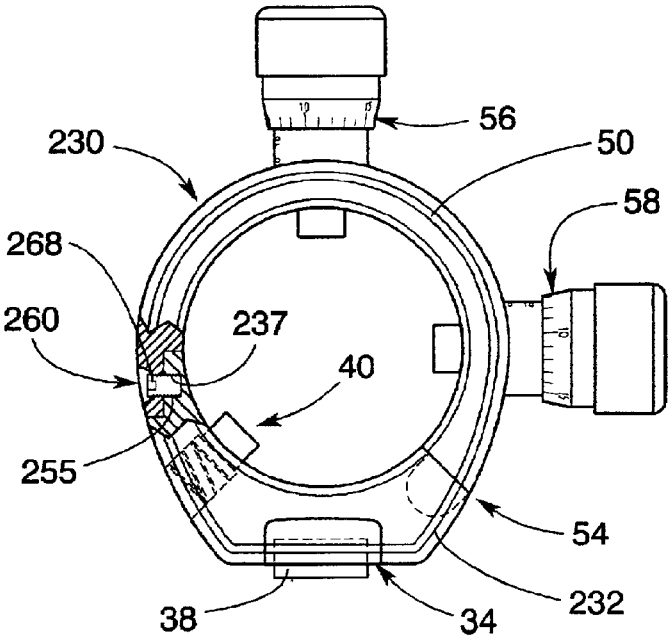
FIG. 15 is a front view of another rear mounting assembly embodiment of the present invention.

FIGS. 12–14 depict another embodiment of a rear mounting assembly 230 of the present invention which may be identical to the embodiments described above except for the latch assembly 260. In this embodiment, the latch assembly 262 may include a conventional hex screw 268 that extends through a hole 235 in the first mounting member 32 to be threadedly received in a threaded hole 262 in the second mounting member 50. In the embodiment in FIG. 15, the hex screw 268 extends through a hole 255 in the second mounting member 50 for threaded engagement with a threaded bore 237 in the first mounting member 32.

Figure 16:
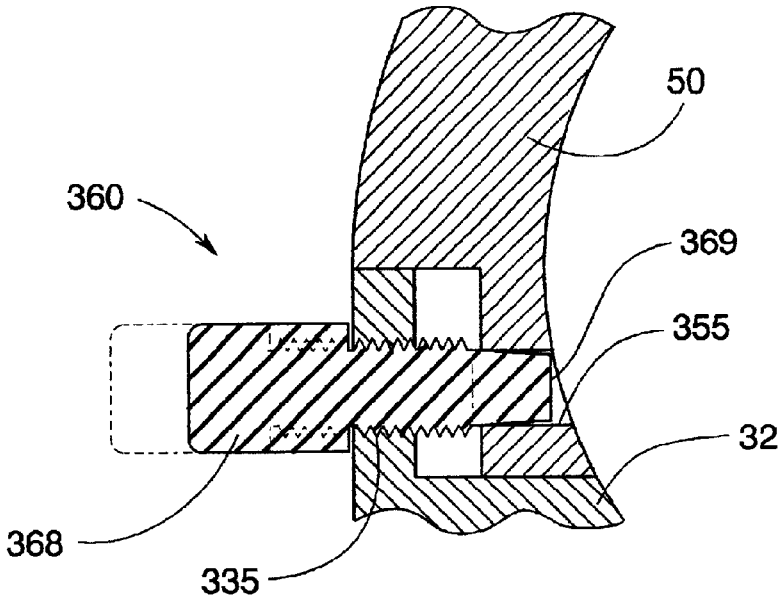
FIG. 16 is an enlarged view of an alternative latch assembly embodiment of the present invention.
Figure 17:
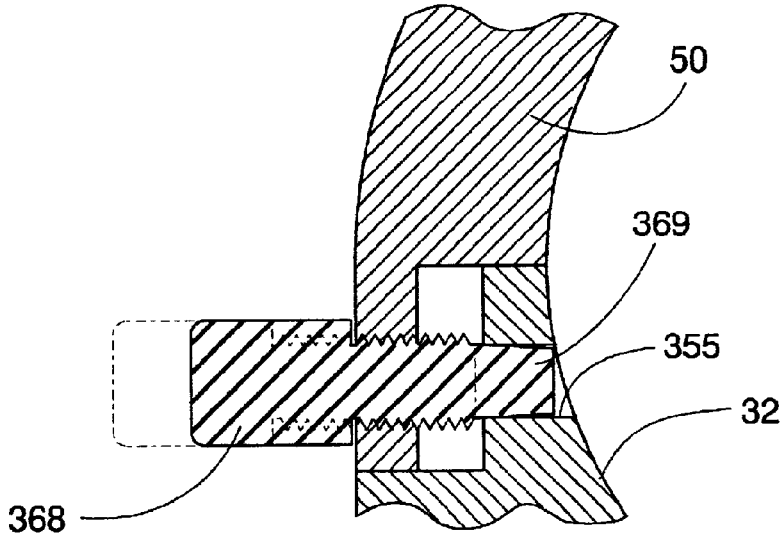
FIG. 17 is an enlarged view of an alternative latch assembly embodiment of the present invention.

FIG. 16 depicts a portion of another latch assembly 360 that may be employed with any of the front mounting assemblies and/or rear mounting assemblies described above. In this embodiment, a threaded hole 335 may be provided in an end of the first mounting member 32 for receiving a threaded lock knob 368 therein. The lock knob 368 may have a slightly tapered end portion 369 that is sized to be retainingly received in a hole 355 in the second mounting member 50 when the second mounting member is in the first position. In the embodiment depicted in FIG. 17, the threaded knob 368 is supported in a portion of the second mounting member 50 and the end portion 369 of the lock knob 368 is designed to be received in a hole 355 in the first mounting member 32 when the second mounting member is in the first position.

Figure 18:
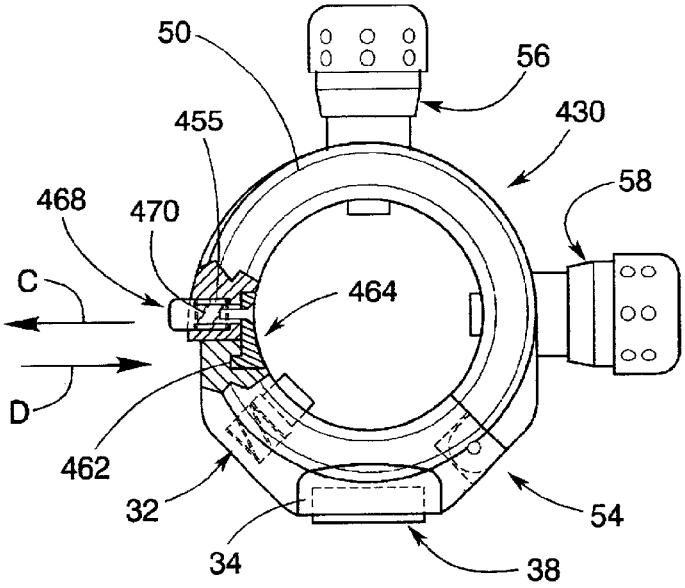
FIG. 18 is a front view of another embodiment of a rear mounting assembly of the present invention in a first position with portions thereof shown in cross-section.
Figure 19:
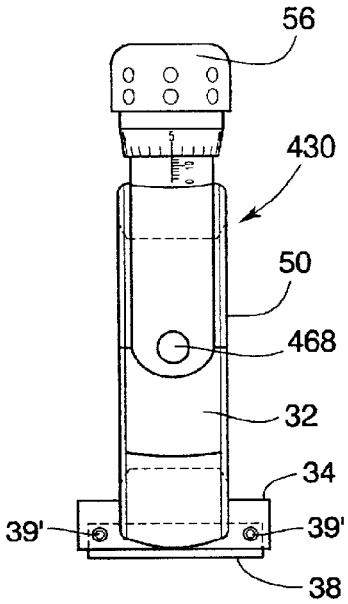
FIG. 19 is a left side elevation view of the rear mounting assembly of FIG. 18.
Figure 20:
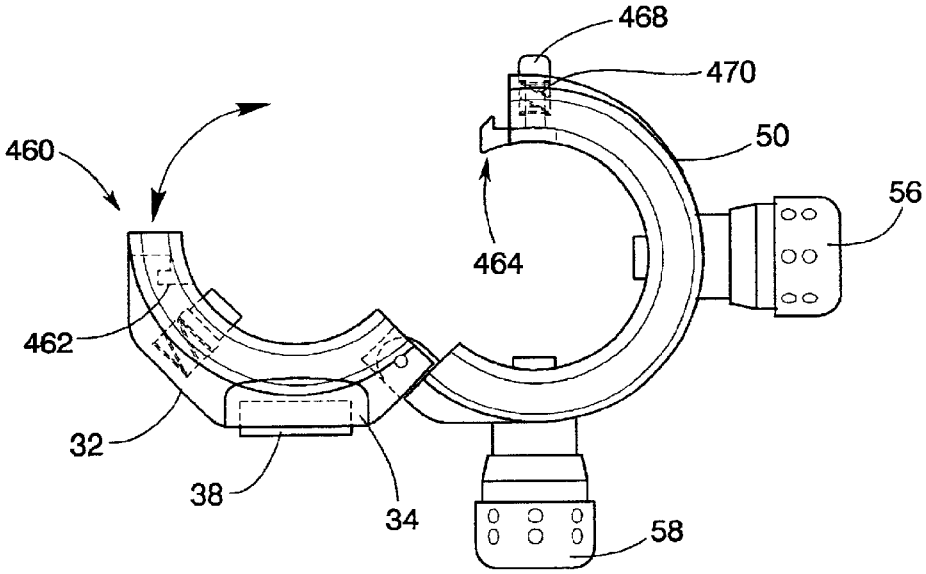
FIG. 20 is a front view of the rear mounting assembly depicted in FIGS. 18 and 19 in a second open position.
Figure 21:
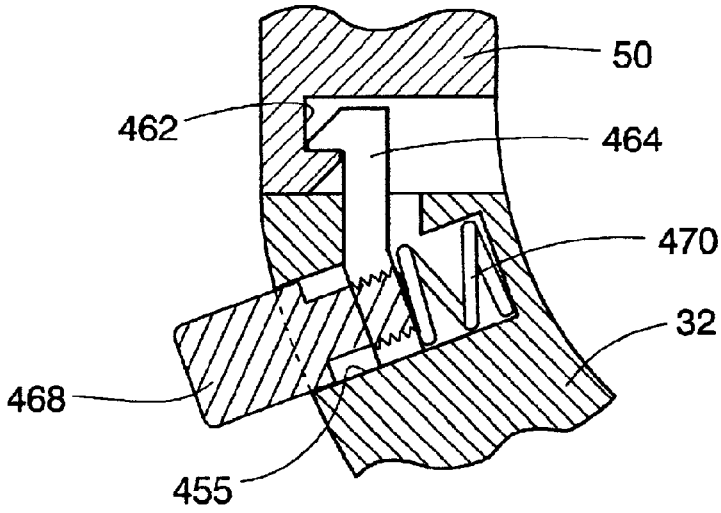
FIG. 21 is an enlarged view of an alternative latch assembly embodiment of the present invention.
Figure 22:
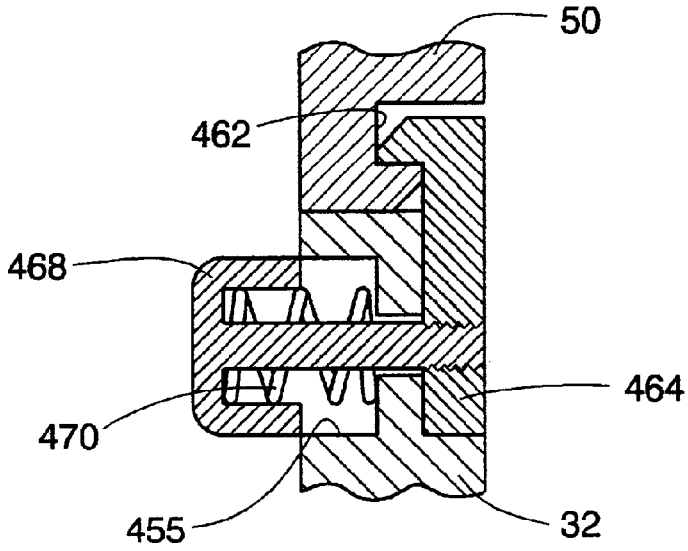
FIG. 22 is an enlarged view of an alternative latch assembly embodiment of the present invention.

FIGS. 18–20 depict another embodiment of a rear mounting assembly 430 of the present invention which may be identical to those embodiments described above, except for the latch assembly 460. The latch assembly may vary somewhat from any of the latch/attachment arrangements disclosed herein, depending upon design, dependability and/or manufacturing considerations, without departing from the spirit and scope of the present invention. Furthermore, the skilled artisan will appreciate that the latch arrangement of this embodiment as well as other similar or related embodiments may be also employed in a front mounting assembly 80. In this embodiment, the latch assembly 460 includes a locking groove 462 in a portion of the first mounting member 32 that is oriented to retainingly receive a latch member 464 that is attached to a push button 468. The latch member 464 may be axially biased out of a latched position by applying an axial force to the push button 468 that is slidably received within a cavity 455 in the second mounting member 50. A biasing member in the form of a spring 470 or other suitable resilient member is positioned between the bottom of the cavity 455 and the push button 468 to apply a biasing force in the "C" direction to the push button 468. To unlatch the latch assembly 460, the user simply applies a biasing force in the "D" direction to the push button 468 to move the latch member 464 out of engagement with the lock groove 462. The embodiment depicted in FIG. 21, may be similar to that embodiment described immediately above, except that the lock groove 462 is provided in the second mounting member 50 and the latch member 464, the push button 468 and biasing member 470 are supported on the first mounting member 32. In the embodiment depicted in FIG. 22, the biasing member 470 is oriented between the push button 468 and a bottom of the cavity 455 in which the push button 468 is received.

Figure 23:
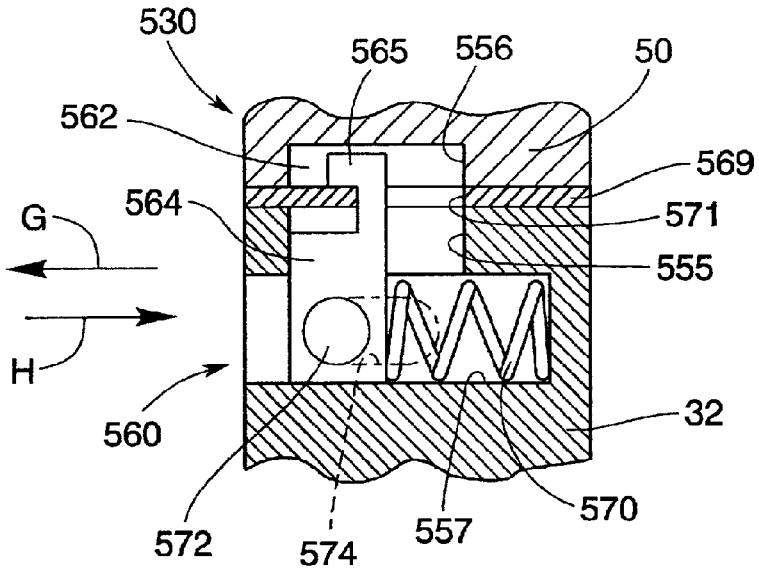
FIG. 23 is an enlarged view of an alternative latch assembly embodiment of the present invention.

FIG. 23 depicts yet another embodiment of a rear mounting assembly 530 of the present invention that, except for the latch assembly 560, may be identical in construction to the various embodiments described above. Again, however, those of ordinary skill in the art will appreciate that various modifications/alterations in the design and construction of the latch assembly employed in this embodiment may be made without departing from the spirit and scope of the present invention. Those of ordinary skill in the art will further appreciate that the latch assembly 560 may also be effectively employed in a front mounting assembly 80 described above. In this embodiment, the latch assembly 560 includes a latch member 564 that is laterally slidably supported within an opening 555 formed in an end of the first mounting member 32. A biasing member in the form of, for example, a spring 570 is provided in a portion of a cavity 557 in the first mounting member 32 to bias the latch member 564 in the "G" direction. The latch member 564 has a catch 565 formed on the end that protrudes from the opening 555 to engage a locking groove 562 formed in the end of the second mounting member 50. In one embodiment, the locking groove 562 is formed by providing a cavity 556 in the end of the second mounting member 50 and providing another end member, such as a washer 569 or the like that has an opening 571 therein through which the latch member 564 may pass as shown in FIG. 23. The end member 569 may be attached to the second mounting member 50 by appropriate mechanical fastening means such as by, for example, screws, glue, solder, etc. The latch member 564 may also be provided with an actuator protrusion 572 that protrudes through an elongated slot 574 (represented by dashed lines in FIG. 23) in the first mounting member 32. To unlatch the latch member 564, the user applies a biasing force in the "H" direction to slide the latch portion 565 out of the locking groove 562.

Figure 24:
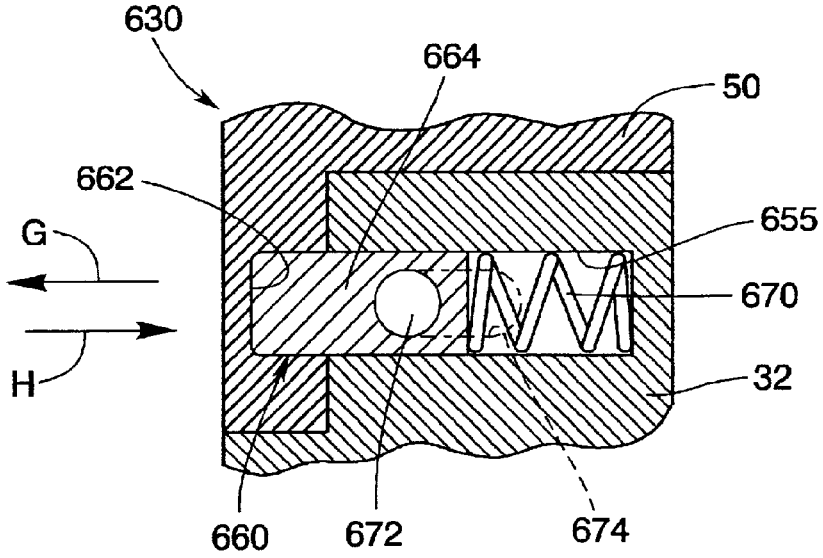
FIG. 24 is an enlarged view of an alternative latch assembly embodiment of the present invention.

Another embodiment of a rear mounting assembly 630 of the present invention is depicted in FIG. 24 and may be identical to the above-described embodiments except for the latch assembly 660. Those of ordinary skill in the art will appreciate that the latch assembly 660 could also be successfully employed in connection with a front mounting assembly 80 of the type described above. In this embodiment, the latch assembly 660 comprises a latch pin 664 that is laterally retained within a cavity 655 provided in the end of the first mounting member 32. An actuator opening 674 (shown in dashed lines in FIG. 24) is provided through a portion of the first mounting member 32 and communicates with the latch pin cavity 655. An actuator pin 672 extends through the actuator opening 674 and is attached to the latch pin 664 (by threads, glue, etc.) for actuating the latch pin 664 laterally within the cavity 655. A biasing member in the form of a spring 670 is provided in the cavity 655 between the latch pin 664 and the bottom of the cavity 655 to bias the latch pin 664 the "G" direction. A locking groove 662 is provided in the end of the second mounting member 50 to receive an end of the latch pin 664 therein to releasably retain the second mounting member 50 in the first position. Those of ordinary skill in the art will appreciate that the latch pin may be effectively located in the second mounting member 50 (with the locking groove in the first mounting member) and operate in substantially the same way.

Figure 25:
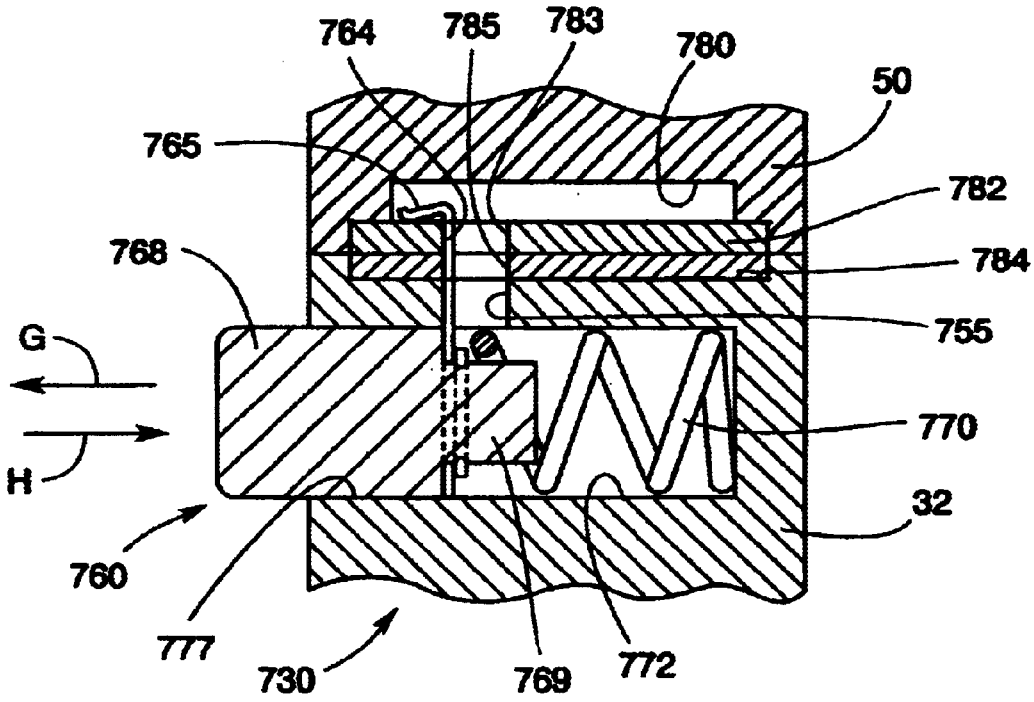
FIG. 25 is an enlarged view of an alternative latch assembly embodiment of the present invention.

Another embodiment of a rear mounting assembly 730 of the present invention is depicted in FIG. 24. However, those of ordinary skill in the art will appreciate that the latch assembly 760 of this embodiment could also be effectively employed in connection with a front mounting assembly 80. This embodiment may be identical to the embodiments described above, except for the latch assembly 760. In this embodiment, the latch assembly 760 includes a latch member 764 that is laterally slidably supported within an opening 755 formed in an end of the first mounting member 32. One end of the latch assembly 764 is journaled on a protrusion 769 formed on a push button 768 that is slidably supported within a cavity 777 also provided in an end of the first mounting member 32. A biasing member in the form of, for example, a spring 770 is provided in the cavity 772 and serves to bias the latch member 764 and push button 768 in the "G" direction. In one embodiment, a cavity 780 is provided in an end of the second mounting member 50. A first washer 782 may be attached to the end of the second mounting member by appropriate fastening means such as by solder, welding, glue, screws, etc. Similarly another washer 784 may be attached to an end of the first mounting member 32 in a similar manner. The latch member 764 has a catch 765 formed on the end that protrudes from the opening 755 and through the openings 783, 785 in the washers 782, 784, respectively as shown in FIG. 25 to thereby retain the second mounting member 50 in the latched position.

Figure 26:
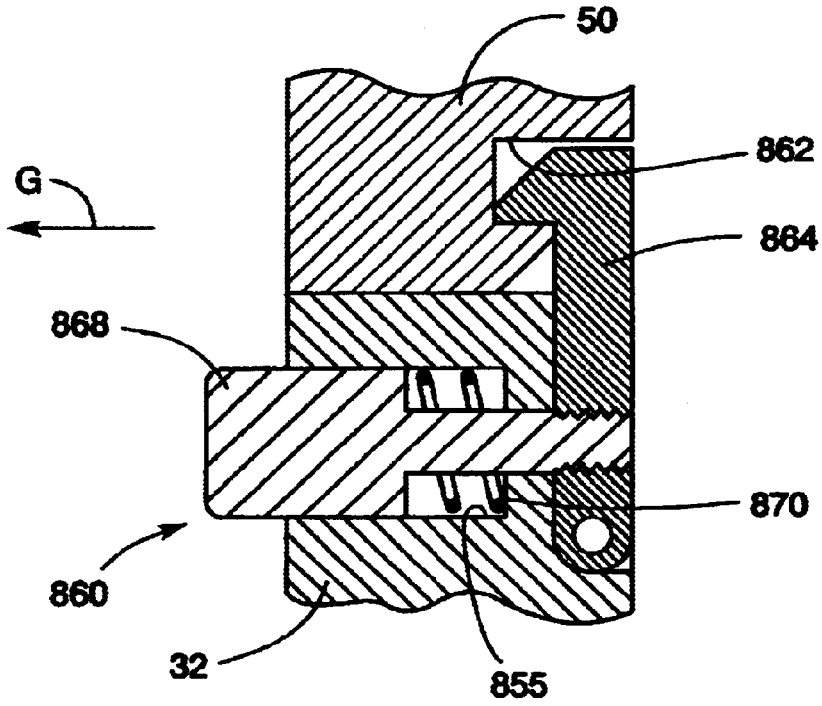
FIG. 26 is an enlarged view of an alternative latch assembly embodiment of the present invention.

FIG. 26 depicts another latch assembly 860 arrangement that may be employed with the various rear mounting assembly embodiments of the present invention and may also be employed in connection with a front mounting assembly 80 of the present invention. In this embodiment, the latch assembly 860 includes a latch pin 864 that is pivotally pinned to the first mounting member 32. A push button 868 is attached to the latch pin 864 as shown and is axially supported in a cavity 855 provided in the first mounting member 32. A spring 870 or other biasing member is provided between the push button 868 and the bottom of the cavity 855 to bias the latch member 864 in the "G" direction. A lock groove 862 is provided in the end of the second mounting member 50 to receive an end of the latch member 864 when the second mounting member 50 is in the latched position. Those of ordinary skill in the art will appreciate that the lock groove 862 could also be placed in the first mounting member 32 and the push button 868, spring 870 and latch member 864 be mounted to the second mounting member in the manner described above without departing from the spirit and scope of the present invention.

Figure 27:
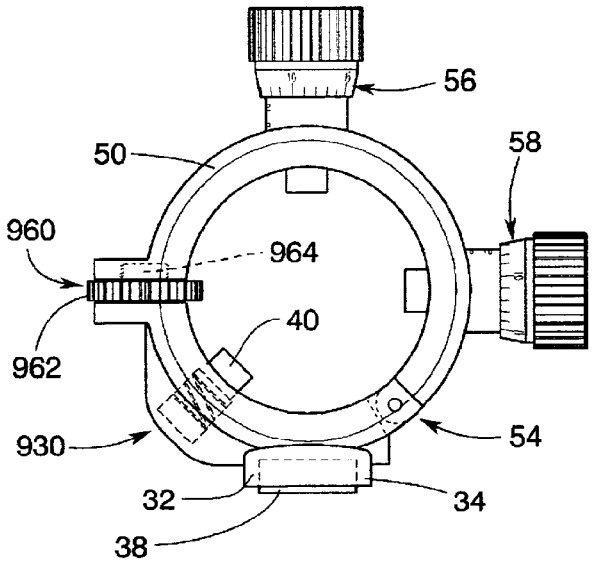
FIG. 27 is a front view of another embodiment of a rear mounting assembly of the present invention in a first position with portions thereof shown in cross-section.
Figure 28:
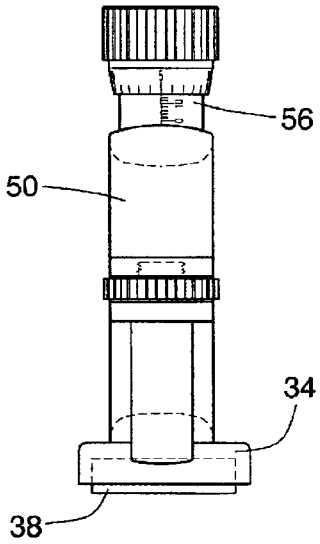
FIG. 28 is a left side elevation view of the rear mounting assembly of FIG. 27.
Figure 29:
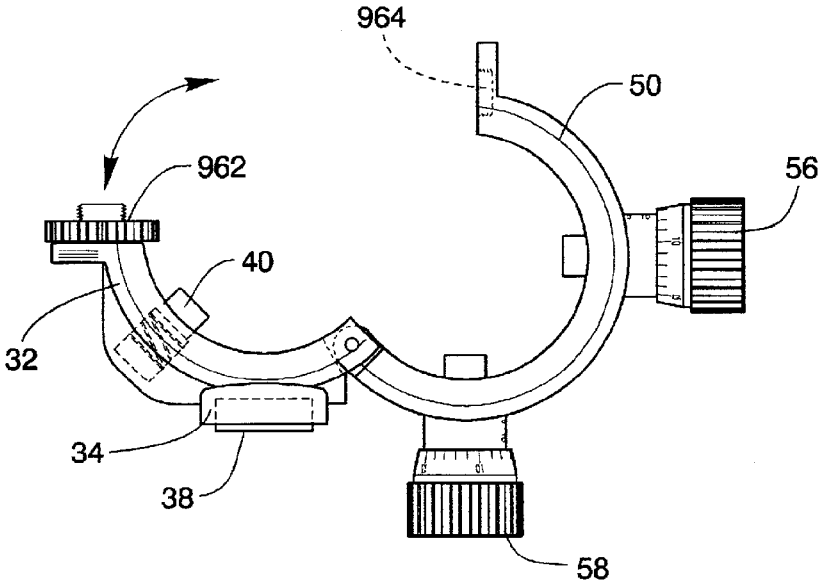
FIG. 29 is a front view of the rear mounting assembly depicted in FIGS. 27 and 28 in a second open position.

Another embodiment of a rear mounting assembly 930 of the present invention is depicted in FIGS. 27–29. The reader will understand that, except for the latching assembly 960, the rear mounting assembly 930 may be constructed like any of the other rear mounting assembly embodiments described above. It will be further understood that the front mounting assembly 80 may also be fabricated with the latching assembly 960. In this embodiment, a thumbscrew 962 is rotatably supported in an end of the first mounting member 32. A corresponding threaded hole 964 is provided in the end of the second mounting member 50 for threadedly receiving a portion of the thumbscrew 962 therein when the second mounting member is in the first position. See FIG. 27. Those of ordinary skill in the art will appreciate that the location of the thumbscrew 962 and the threaded hole 964 may be reversed. That is, the thumbscrew 962 may be rotatably affixed to the end of the second mounting member 50 and the threaded hole 964 may be provided in the end of the first mounting member 32 without departing from the spirit and scope of the present invention.

Figure 30:
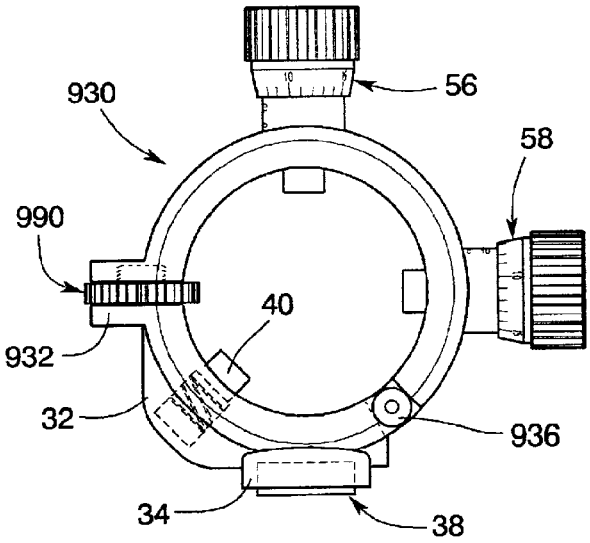
FIG. 30 is a front view of another embodiment of a rear mounting assembly of the present invention in a first position with portions thereof shown in cross-section.
Figure 31:
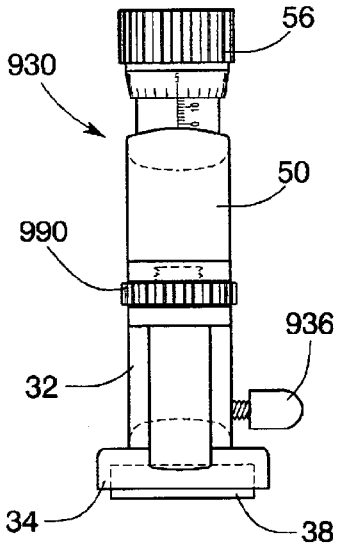
FIG. 31 is a left side elevation view of the rear mounting assembly of FIG. 30.
Figure 32:
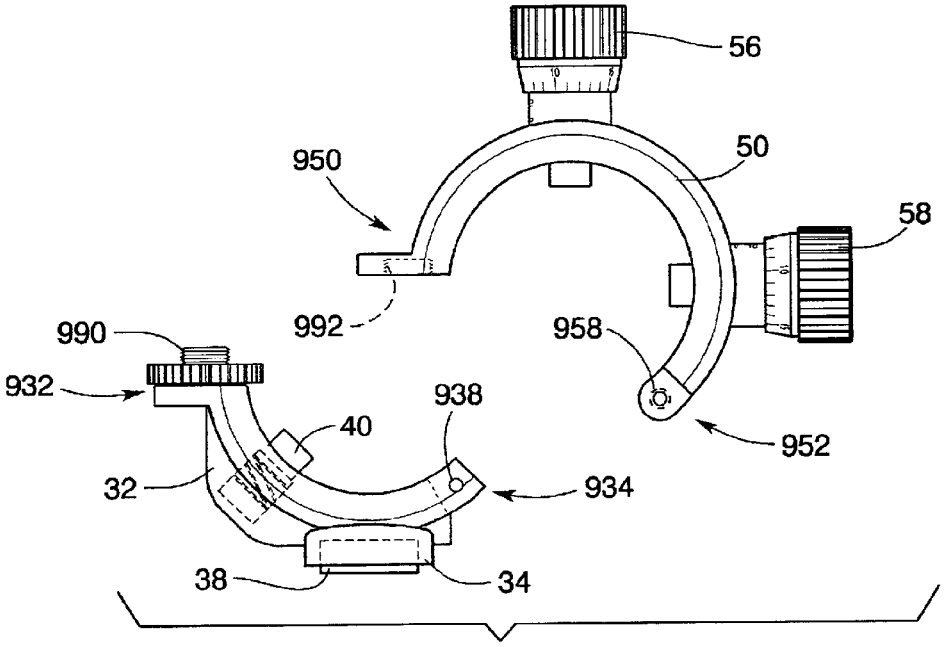
FIG. 32 is an exploded assembly view of the rear mounting assembly of FIGS. 30 and 31.

Yet another embodiment of the present invention is depicted in FIGS. 30–32. In this embodiment, the second mounting member 50 is removably affixed to the first mounting member 32 by a thumbscrew 990 that is rotatably supported on a first end 932 of the first mounting member 32 and received in a corresponding threaded bore 992 in a first end 950 of the second mounting member 50. The second end 952 of the of second mounting member 50 is removably affixed to the second end 934 of the first mounting member 32 by a threaded knob 936 that extends through a hole 938 in the second mounting member 32 to be threadedly received in a threaded hole 958 in the first mounting member 32. See FIG. 31. Such arrangement permits the second mounting member 50 to be completely removed from the first mounting member 32 to permit installation and removal of the telescopic sight 20.

As can be appreciated from the above-described embodiments, when mounting assemblies are open, the scope can easily be removed or reinserted. When the scope has been removed, the micrometer and spring type elevation and windage adjustments would remain unaffected so that when the removed scope (or any other scope) is reinserted, it would be sighted exactly as it had been before removal of the scope. Forms of hinges and locking devices are shown and described, although the substance of the invention is not tied to these particular devices, as there are numerous types of clasps, locking devices and hinges, or even locking devices on both sides without any hinge, which could be employed to effect the unique benefit of the subject invention.

In addition to the aforementioned, various embodiments of the subject invention provide for the easy attachment of the mounting assemblies to a variety of different types of firearms. Most modern American and overseas manufactured rifles have predrilled holes to accommodate various existing bases or mounts for the popular internal adjustment type scopes used today. These are at different locations and at different distances from each other and are predrilled for different size screws with different threads. Today, one must buy the base and mount which is uniquely sized for the particular rifle involved. The subject invention would provide for a small block which would have holes through it at various points such that it could be attached to a large percentage of new and existing rifles. Because various embodiments of this insert base could be covered completely by a mounting assembly, the extra and unused holes would not create an unsightly cosmetic detriment because they could not be after the mounting assembly has been attached. Such arrangement could facilitate the use of "universal" shims between the base and the insert or under the insert to further increase the elevation adjustment of the scope, if necessary.

Thus, the subject invention eliminates what is now an ever-present headache for the rifleman. Today there are hundreds, if not thousands, of different types of bases, mounts and rings, almost all of which operate somewhat differently to accommodate the wide range of internal adjustment type scopes and the myriad peculiarities of the rifle to which the scope is intended to be attached. It is a rare sportsman who has not more than once bought the "wrong" mounts and/or bases only to find he must make another trip to get the "right" ones.

Today many of these prior mounting devices require gunsmithing services, machining and often specially manufactured shims to make the scope work on a particular rifle—even for very popular rifles mass-produced in the United States. Accordingly, this one feature of the subject invention will further assist in the easy interchangeability of rifle scopes. The subject invention will also make easier the changeover from existing mounts and scopes to the mounting assemblies of various embodiments of the subject invention without required gunsmithing services.

Whereas particular embodiments of the invention have been described herein for the purpose of illustrating the invention and not for the purpose of limiting the same, it will be appreciated by those of ordinary skill in the art that numerous variations of the details, materials and arrangement of parts may be made within the principle and scope of the invention without departing from the spirit invention. The preceding description, therefore, is not meant to limit the scope of the invention. Rather the scope of the invention is to be determined only by the appended claims and their equivalents.

What is claimed is:

1. Apparatus for removably mounting an optical sighting device to a firearm, said apparatus comprising:

a first mounting member attachable to the firearm and having a first end and a second end and being shaped to support a portion of the optical sighting device between said first end and said second end;

a second mounting member having a primary end and a secondary end, said primary end being pivotally coupled to said first end of said first mounting member by a hinge assembly, said secondary end being selectively movable between a first position adjacent said second end of said first mounting member to define an area for movably receiving a portion of the optical sighting device therein, and a second position wherein the secondary end of said second mounting member is remote from said first mounting member such that the portion of the optical sighting device may be removed from said area between said first and second mounting members;

a latch assembly coupled to one of said first and second mounting members for releasably affixing said secondary end of said second mounting member to said second end of said first mounting member while maintaining said area for movably receiving the portion of the optical sighting device therein;

a windage adjustment member supported on one of said first and second mounting members for contact with the portion of the optical sighting device within said area;

an elevation adjustment member supported on one of said first and second mounting members for contact with the portion of the optical sighting device within said area; and a resilient support member in one of said first and second mounting members for contact with the portion of the optical sighting device within said area to movably bias the portion of the optical sighting device into contact with said windage adjustment member and said elevation adjustment member.

2. The apparatus of claim 1 where said windage adjustment member and said elevation adjustment member are supported on said second mounting member and said resilient support member is supported on said first mounting member.

3. The apparatus of claim 1 wherein said latch assembly comprises:

a locking groove in a portion of said second mounting member; and a latch member movably supported on said first mounting member and being selectively movable between a latched position wherein said latch member is retainingly received in said locking groove and an unlatched position.

4. The apparatus of claim 3 wherein said latch member is selectively movable between said latched position and said unlatched position by a threaded member supported in said first mounting member and in threaded engagement with said latch member to axially move said latch member between said latched position and said unlatched position.

5. The apparatus of claim 3 wherein said latch member is slidably supported in said first mounting member and is selectively slidable between said latched position and said unlatched position and wherein said apparatus further comprises a latch biasing member in said first mounting member for biasing said latch member to said latched position.

6. The apparatus of claim 3 wherein said latch member is pivotally attached to said first mounting member and is selectively pivotable between said latched position and said unlatched position and wherein said apparatus further comprises:

a push button attached to said latch member and movably supported in said first mounting member; and a latch biasing member in said first mounting member in biasing contact with said push button for biasing said push button and said latch member to said latched position.

7. The apparatus of claim 3 wherein said latch member is pivotally attached to said first mounting member and is selectively pivotable between said latched position and said unlatched position and wherein said apparatus further comprises a latch biasing member between said latch member and a portion of said first mounting member to bias said latch member to said latched position.

8. The apparatus of claim 3 wherein said resilient support member comprises:

a boss movably supported within a hole in said first mounting member; and a biasing member in said hole for applying a biasing force to said boss.

9. The apparatus of claim 8 further comprising:

a mounting insert attachable to the firearm;

an insert cavity in a base portion of said first mounting member sized to receive a portion of said mounting insert therein; and at least one releasable retainer for attaching said base portion of said first mounting member to said insert.

10. The apparatus of claim 9 wherein said insert has at least one hole therein that corresponds with at least one mounting hole in the firearm.

11. The apparatus of claim 3 wherein said windage adjustment member comprises a micrometer type assembly and wherein said elevation adjustment member comprises another micrometer type assembly.

12. The apparatus of claim 1 wherein said latch assembly comprises:

a locking groove in a portion of said first mounting member; and a latch member movably supported on said second mounting member and being selectively movable between a latched position wherein said latch member is retainingly received in said locking groove and an unlatched position.

13. The apparatus of claim 12 wherein said latch member is selectively movable between said latched position and said unlatched position by a threaded member supported in said second mounting member and in threaded engagement with said latch member to axially move said latch member between said latched position and said unlatched position.

14. The apparatus of claim 12 wherein said latch member is slidably supported in said second mounting member and is selectively slidable between said latched position and said unlatched position and wherein said apparatus further comprises a latch biasing member in said second mounting member for biasing said latch member to said latched position.

15. The apparatus of claim 12 wherein said latch member is pivotally attached to said second mounting member and is selectively pivotable between said latched position and said unlatched position and wherein said apparatus further comprises:

a push button attached to said latch member and movably supported in said second mounting member; and a latch biasing member in said second mounting member in biasing contact with said push button for biasing said push button and said latch member to said latched position.

16. The apparatus of claim 12 wherein said resilient support member comprises:

a boss movably supported within a hole in said first mounting member; and a biasing member in said hole for applying a biasing force to said boss.

17. The apparatus of claim 12 further comprising:

a mounting insert attachable to the firearm;

an insert cavity in a base portion of said first mounting member sized to receive a portion of said mounting insert therein; and at least one retainer for attaching said base portion of said first mounting member to said insert.

18. The apparatus of claim 17 wherein said insert has at least one hole therein that corresponds with at least one mounting hole in the firearm.

19. The apparatus of claim 12 wherein said windage adjustment member comprises a micrometer type assembly and wherein said elevation adjustment member comprises another micrometer type assembly.

20. The apparatus of claim 1 wherein said latch assembly comprises:

a threaded bore in said first mounting member; and a threaded lock member supported in said second mounting member and being selectively threadably engagable with said threaded bore in said first mounting member when said second mounting member is in said first position.

21. The apparatus of claim 20 wherein said resilient support member comprises:

a boss movably supported within a hole in said first mounting member; and a biasing member in said hole for applying a biasing force to said boss.

22. The apparatus of claim 20 further comprising:

a mounting insert attachable to the firearm;

an insert cavity in a base portion of said first mounting member sized to receive a portion of said mounting insert therein; and at least one releasable retainer for attaching said base portion of said first mounting member to said insert.

23. The apparatus of claim 22 wherein said insert has a plurality of apertures therethrough that correspond with mounting holes in the firearm.

24. The apparatus of claim 20 wherein said windage adjustment member comprises a micrometer type assembly and wherein said elevation adjustment member comprises another micrometer type assembly.

25. The apparatus of claim 1 wherein said latch assembly comprises:

a threaded bore in said second mounting member; and a threaded lock member supported in said first mounting member being selectively threadably engagable with said threaded bore in said second mounting member when said second mounting member is in said first position.

26. The apparatus of claim 25 wherein said resilient support member comprises:

a boss movably supported within a hole in said first mounting member; and a biasing member in said hole for applying a biasing force to said boss.

27. The apparatus of claim 25 further comprising:

a mounting insert attachable to the firearm;

an insert cavity in a base portion of said first mounting member sized to receive a portion of said mounting insert therein; and at least one retainer for attaching said base portion of said first mounting member to said insert.

28. The apparatus of claim 27 wherein said insert has at least one hole therein that corresponds with at least one mounting hole in the firearm.

29. The apparatus of claim 25 wherein said windage adjustment member comprises a micrometer assembly and wherein said elevation adjustment member comprises another micrometer assembly.

30. The apparatus of claim 1 wherein said latch assembly comprises:

a lock opening in said second mounting member; and a threaded lock pin threadably supported in said first mounting member, said threaded lock pin having a tapered lock end receivable in said lock opening in said second mounting member when said second mounting member is in said first position.

31. The apparatus of claim 30 wherein said resilient support member comprises:

a boss movably supported within a hole in said first mounting member; and a biasing member in said hole for applying a biasing force to said boss.

32. The apparatus of claim 30 further comprising:

a mounting insert attachable to the firearm;

an insert cavity in a base portion of said first mounting member sized to receive a portion of said mounting insert therein; and at least one retainer for attaching said base portion of said first mounting member to said insert.

33. The apparatus of claim 32 wherein said insert has at least one hole therein that corresponds with at least one mounting hole in the firearm.

34. The apparatus of claim 30 wherein said windage adjustment member comprises a micrometer assembly and wherein said elevation adjustment member comprises another micrometer assembly.

35. The apparatus of claim 1 comprising:

a threaded hole in an end of said second mounting member opposite from said hinge assembly; and a threaded retainer operably attached to an end of said first mounting member opposite said hinge assembly for threaded engagement with said threaded hole when said second mounting member is in said first position.

36. The apparatus of claim 35 wherein said resilient support member comprises:

a boss movably supported within a hole in said first mounting member; and a biasing member in said hole for applying a biasing force to said boss.

37. The apparatus of claim 35 further comprising:

a mounting insert attachable to the firearm;

an insert cavity in a base portion of said first mounting member sized to receive a portion of said mounting insert therein; and at least one releasable retainer for attaching said base portion of said first mounting member to said insert.

38. The apparatus of claim 35 wherein said windage adjustment member comprises a micrometer assembly and wherein said elevation adjustment member comprises another micrometer assembly.

39. The apparatus of claim 1 wherein said resilient support member comprises:

a boss movably supported within a hole in said first mounting member; and a biasing member in said hole for applying a biasing force to said boss.

40. The apparatus of claim 1 further comprising:

a mounting insert attachable to the firearm;

an insert cavity in a base portion of said first mounting member sized to receive a portion of said mounting insert therein; and at least one retainer for attaching said base portion of said first mounting member to said insert.

41. The apparatus of claim 40 wherein said insert has at least one hole therethrough that corresponds with at least one mounting hole in the firearm.

42. The apparatus of claim 1 wherein the optical sighting device is a telescopic sight with a fixed reticle.

43. The apparatus of claim 42 wherein said telescopic sight is multi-powered.

44. The apparatus of claim 1 wherein said windage adjustment member comprises a micrometer type assembly and wherein said elevation adjustment member comprises another micrometer type assembly.

45. Apparatus for removably mounting a telescopic sight to a firearm, said apparatus comprising:

a first mounting means attachable to the firearm, said first mounting means supporting a portion of the telescopic sight on a portion of the firearm;

a second mounting means movably coupled to said first mounting means, said second mounting means selectively movable between a first position wherein the portion of the telescopic sight is movably supported between said first mounting means and said second mounting means and a second position wherein the portion of the telescopic sight may be removed from between said first mounting means and said second mounting means;

means attached to one of said first and second mounting means for selectively adjusting windage of the telescopic sight when the portion of the telescopic sight is received between said first and second mounting means;

means attached to one of said first and second mounting means for selectively adjusting elevation of the telescopic sight when the portion of the telescopic sight is received between said first and second mounting means;

resilient support means for supporting the portion of the telescopic sight received between the first and second mounting means; and means for releasably latching a portion of said second mounting means to said first mounting means when said second mounting means is in said first position.

46. Apparatus for removably mounting an optical sighting device to a firearm, said apparatus comprising:

a primary mounting member attachable to the firearm and shaped to support a portion of the optical sighting device therein;

a secondary mounting member movably coupled to said primary mounting member and being selectively movable between a primary position wherein the optical sighting device is supported between said primary mounting member and said secondary mounting member and a secondary position wherein the optical sighting device may be removed from between said primary and secondary mounting members;

at least one support member in said primary mounting member; and at least two adjustable support members in said secondary mounting member.

47. The apparatus of claim 46 wherein said secondary mounting member is pivotally coupled to said primary mounting member by a hinge assembly.

48. The apparatus of claim 46 further comprising a latch assembly in one of said primary and secondary mounting members for releasably retaining said secondary mounting member in said primary position.

49. The apparatus of claim 48 wherein said latch assembly comprises:

a locking groove in a portion of said secondary mounting member; and a latch member movably supported on said primary mounting member and being selectively movable between a latched position wherein said latch member is retainingly received in said locking groove and an unlatched position.

50. The apparatus of claim 46 wherein said support members are resilient.

51. A telescopic sight system for a firearm, comprising:

a telescopic sight;

at least two mounting assemblies attached to the firearm for detachably supporting a portion of said telescopic sight on the firearm wherein at least one said mounting assembly comprises:

a first mounting member attached to the firearm and shaped to support a portion of said telescopic sight therein;

a second mounting member pivotally coupled to said first mounting member and being selectively pivotable between a first retaining position wherein the one portion of said telescopic sight is supported between said first and second mounting members and a second position wherein the one portion of the telescopic sight may be removed from between said first and second mounting members;

a windage adjustment member supported on said first mounting member;

an elevation adjustment member supported on said second mounting member; and a resilient support member mounted to said second mounting member.

52. The telescopic sight system of claim 51 further comprising a biasing member between one of said mounting assemblies and a protruding portion of said telescopic sight.

* * * * *

UNITED STATES PATENT AND TRADEMARK OFFICE

CERTIFICATE OF CORRECTION

PATENT NO. : 6,705,037 B2
DATED : March 16, 2004
INVENTOR(S) : J. Robert Van Kirk It is certified that error appears in the above-identified patent and that said Letters Patent is hereby corrected as shown below:

Title page,
Item [56], References Cited, insert:
-- OTHER PUBLICATIONS cover of Precision Shooting, September 2000

Gun Tests Accessories Handbook Optics: Large Objective
Rifle Scopes, 1995, pgs. 20-29

Leupold, Like Our Scopes, This Booklet Is Worth Keeping, 1999,
Pgs. 1-13. --.

Column 10,
Line 16, delete "maimers" and replace therewith -- manners --.

Signed and Sealed this

Twentieth Day of September, 2005

JON W. DUDAS
*Director of the United States Patent and Trademark Office*